US007064625B2

(12) United States Patent
Powell

(10) Patent No.: US 7,064,625 B2
(45) Date of Patent: Jun. 20, 2006

(54) TRANSMISSION LINE STRUCTURES

(75) Inventor: Royston Powell, Hartwell (GB)

(73) Assignee: Bookham Technology, PLC, Towcester (GB)

( * ) Notice: Subject to any disclaimer, the term of this patent is extended or adjusted under 35 U.S.C. 154(b) by 0 days.

(21) Appl. No.: 10/498,689

(22) PCT Filed: Dec. 10, 2002

(86) PCT No.: PCT/GB02/05602

§ 371 (c)(1),
(2), (4) Date: Jun. 14, 2004

(87) PCT Pub. No.: WO03/050910

PCT Pub. Date: Jun. 19, 2003

(65) Prior Publication Data

US 2005/0128021 A1 Jun. 16, 2005

(30) Foreign Application Priority Data

Dec. 11, 2001 (GB) ..... 0129654.0

(51) Int. Cl.
*H01P 3/08* (2006.01)
*H01P 1/24* (2006.01)

(52) U.S. Cl. ..... 333/22 R; 333/246; 333/33

(58) Field of Classification Search ..... 333/22 R, 333/246, 33, 34
See application file for complete search history.

(56) References Cited

U.S. PATENT DOCUMENTS 4,413,241 A 11/1983 Bitoune et al.
5,994,983 A * 11/1999 Andersson ..... 333/246

FOREIGN PATENT DOCUMENTS

| | | |
|---|---|---|
| DE | 195 19 724 C | 8/1996 |
| EP | 0 424 536 A | 5/1991 |
| GB | 2 081 980 A | 2/1982 |
| JP | 05 075311 A | 7/1993 |

* cited by examiner

*Primary Examiner*—Stephen E. Jones
(74) *Attorney, Agent, or Firm*—Lahive & Cockfield, LLP; Anthony A. Laurentano, Esq.

(57) ABSTRACT

A composite waveguide termination structure including two different waveguide conductor geometries operatively located upon a common substrate, wherein each such waveguide geometry includes a ground conductor on the same surface of the substrate.

10 Claims, 5 Drawing Sheets

TRANSMISSION LINE STRUCTURES

RELATED APPLICATIONS

This application is a 35 U.S.C. 371 national stage filing of International Application No. PCT/GB02/05602, filed 10 Dec. 2002, which claims priority to Great Britain Patent Application No. 0129654.0 filed on 11 Dec. 2001, in Great Britain. The contents of the aforementioned applications are hereby incorporated by reference.

BACKGROUND OF THE INVENTION

This invention relates to transmission lines and the termination thereof.

In particular the present invention is concerned with the termination of high speed radio frequency (RF) transmission line electrode structures of various forms such as microstrip, co-planar or other alternative geometries.

A factor of considerable importance in the termination of transmission lines is to ensure that any signal reflection of the radio frequency signal arising from the termination should be as low as possible. With such an object in view various proposals have been made in relation to termination of high frequency radio signals.

In practice, it is considered that as the frequency of operation of a transmission line increases the physical size the he termination structure decreases due to the consequential reduction in the signal wavelengths involved.

It is known in the construction of transmission line terminations to make use of a relatively wide variety of materials such as for example, insulating substrates such as ceramics, quartz, or circuit boards from organic materials. Conventionally metallic conductor patterns are applied to the insulating substrates in such arrangement as to form planar transmission lines used for routing either the radio frequency or high-speed digital signals.

In practice, in the formation of both co-planar and microstrip waveguides, the choice of the substrate materials and the particular transmission line structure used is highly dependent on the specific application for the resulting waveguide. In addition, the choice of substrate and transmission line structure influences the performance, size, and cost of the assembled waveguide. However, in general the microstrip design is more widely used than the co-planar design due to its structural robustness and its compatibility in interfacing with active devices. One particular attractive aspect of the known designs of microstrip waveguides is that for a fixed substrate thickness, as the relative dielectric constant, $\in_r$, of the substrate is increased the circuit size is decreased. In view of this alumina ($Al_2O_3$) is a common choice from possible substrate materials as it has a relative dielectric constant $\in_r \approx 10$ and so allows compact microelectronic packages to be manufactured.

However, when designing a microstrip circuit of alumina or other high dielectric constant substrate where there is a need for a serial broadband DC block in a compact circuit layout a design conflict arises.

The serial capacitor assembly is physically large and the requisite mounting pad size is larger than the transmission line width required for 50Ω characteristic impedance. The additional shunt capacitance of the mounting pad results in a poor impedance match to the transmission line. This mismatch in impedance will result in a proportion of the RF signal being reflected rather than transmitted.

It has been found that increasing the substrate thickness will also have the effect of degrading the broadband termination performance in a microstrip design due to the increased path length of the connection that is necessary between the top and bottom surfaces of the substrate resulting in an additional serial inductance.

Another problem with using conventional microstrip or co-planar structures is the difficulty in moving from one form of structure to another when using the same substrate. Thus when effecting a transition from a conventional microstrip waveguide to a conventional co-planar waveguide using the same substrate difficulties arise.

In a conventional co-planar waveguide structure the signal is applied to a central conductor and coupled to two relatively wide ground conductors located on either side of the central conductor on the same side of the substrate. As a result in effecting the transition from the microstrip waveguide there is a need to connect the microstrip ground conductor with the ground conductors of the co-planar waveguide, which are conventionally located on the opposite side of the substrate as compared with that of the microstrip waveguide. It has been found that the effecting of this required interconnection of the ground planes inherently adversely affects the high frequency operation of the combined structure.

SUMMARY OF THE INVENTION

According to a first aspect of the invention there is provided a composite waveguide termination structure including two different waveguide conductor geometries operatively located upon a common substrate, wherein each such waveguide geometry includes a ground conductor on the same surface of the substrate.

According to a second aspect of the invention there is provided a composite waveguide transmission line termination structure including a first microstrip transmission line section including a substrate interposed between a conductor electrode and a ground conductor, a second co-planar transmission line section including a substrate which is an extension of the substrate of the first section, a conductor on the opposite surface to a ground conductor that is provided upon the same surface of the substrate as the ground conductor of the first conductor of the first section and is electrically connected therewith.

According to a third aspect of the invention the waveguide termination structure includes a microstrip transmission line that is arranged to feed into a co-planar transmission line structure having the same substrate as that of the microstrip transmission line in such a manner that the ground conductors of both lines are connected directly to a packaging base for the lines.

Preferably, the conductor electrode of the co-planar waveguide second section is separated into two regions separated by a physical gap of such a size as to allow placement of a DC block capacitor at said gap.

BRIEF DESCRIPTION OF THE DRAWINGS

For a better understanding of the invention and to show how to carry the same into effect reference will be made to the accompanying drawings in which.

DESCRIPTION OF ILLUSTRATED EMBODIMENT

Referring now to the figures the composite waveguide transmission line termination 1 shown therein includes two waveguide forming sections 2 and 3 with, the first section 2 being a microstrip waveguide structure and the second section 3 being a co-planar waveguide structure.

Figure 1:
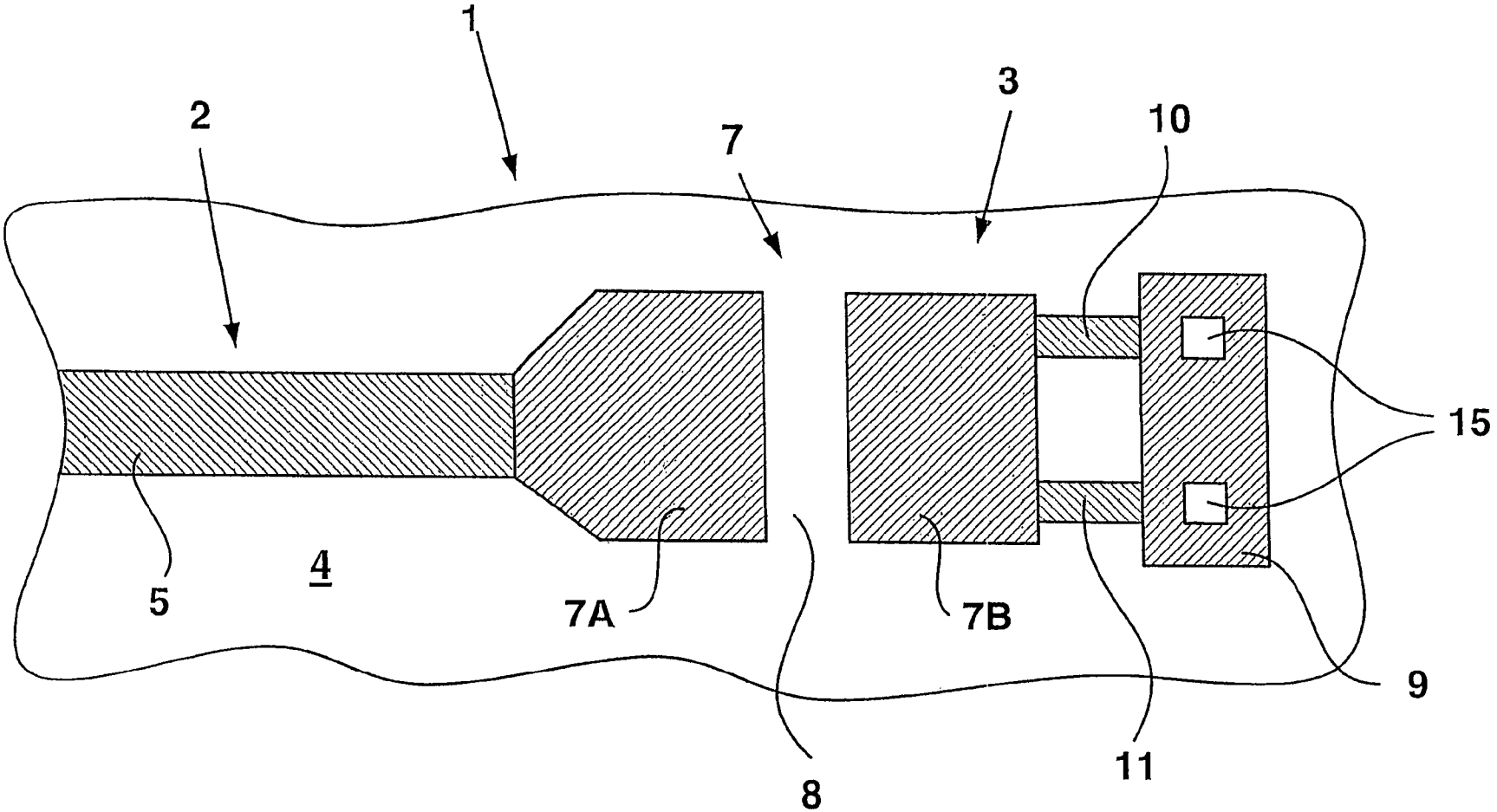
FIG. 1 schematically illustrates in plan view the upper surface of an embodiment for a composite waveguide structure incorporating the concepts of the invention.

The waveguide structures share a common substrate of which the top surface 4 is shown in FIG. 1. The various conductors associated with the waveguide structures are provided upon the top surface 4 of the substrate.

Figure 3:
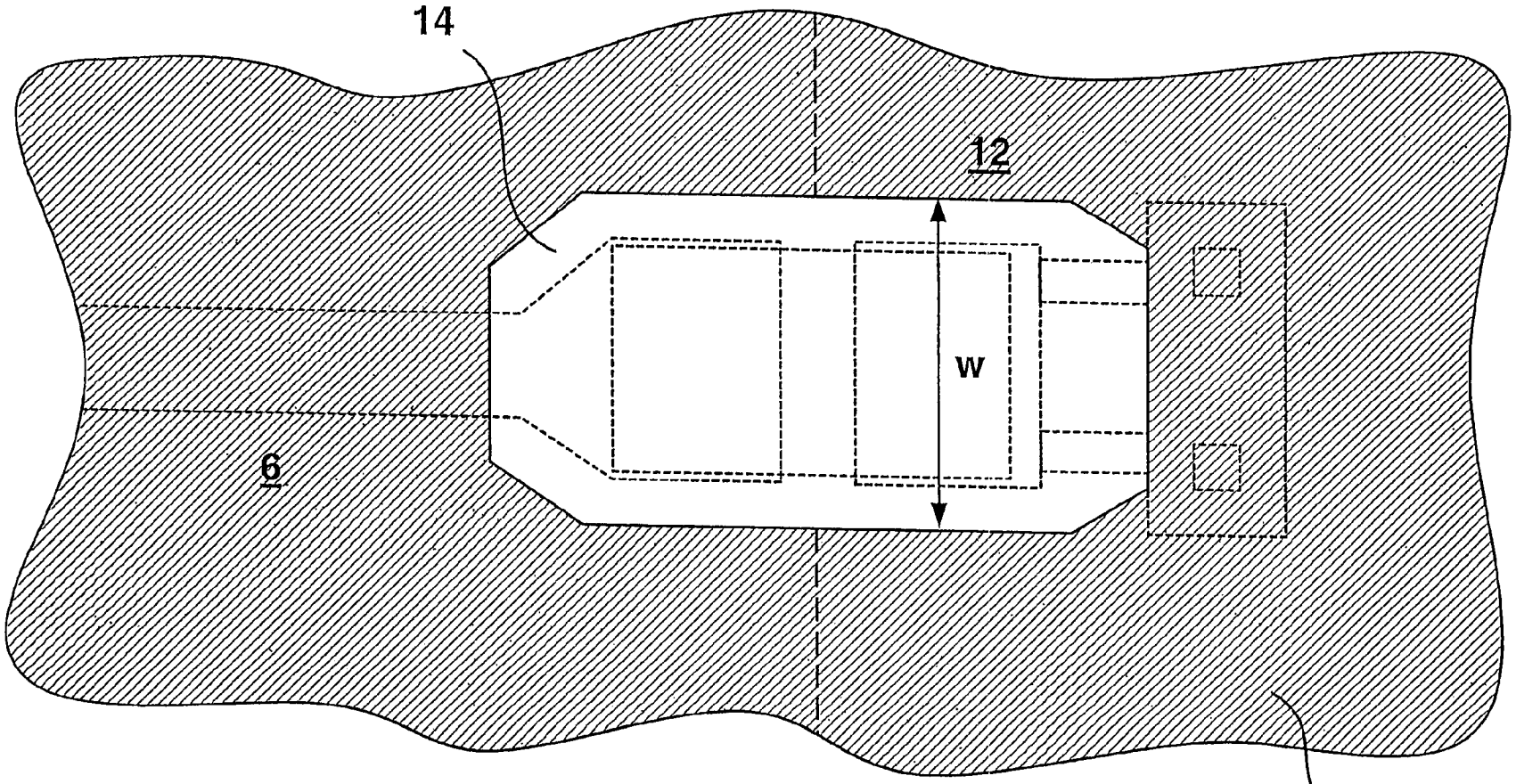
FIG. 3 schematically illustrates the underside of the structure illustrated in FIGS. 1 and 2.

Thus in the case of the microstrip waveguide 2, the latter includes a conductor 5 on said top surface 4 whilst the conventionally included ground plane 6 is provided upon the bottom surface of the substrate as is particularly shown in FIG. 3. The microstrip waveguide conductor 5 electrically connects with the conductor electrode arrangement of the co-planar waveguide structure.

In FIG. 1 this conductor arrangement is shown to include a main conductor 7, which is shown in the figure as being a two part construction 7A and 7B with a gap 8 there between, together with conductor electrodes 9, and sheet resisters 10 and 11. The co-planar planer waveguide structure also includes an outer ground plane 12, which is located, as may be noted from FIG. 3, upon the bottom surface of the substrate. To this extent since the normal practice is, to provide the outer ground plane of a co-planar waveguide upon the same surface as the conductors 7A, 7B, 9, 10 and 11 the resulting structure can be regarded as a modified co-planar waveguide structure.

Figure 2:
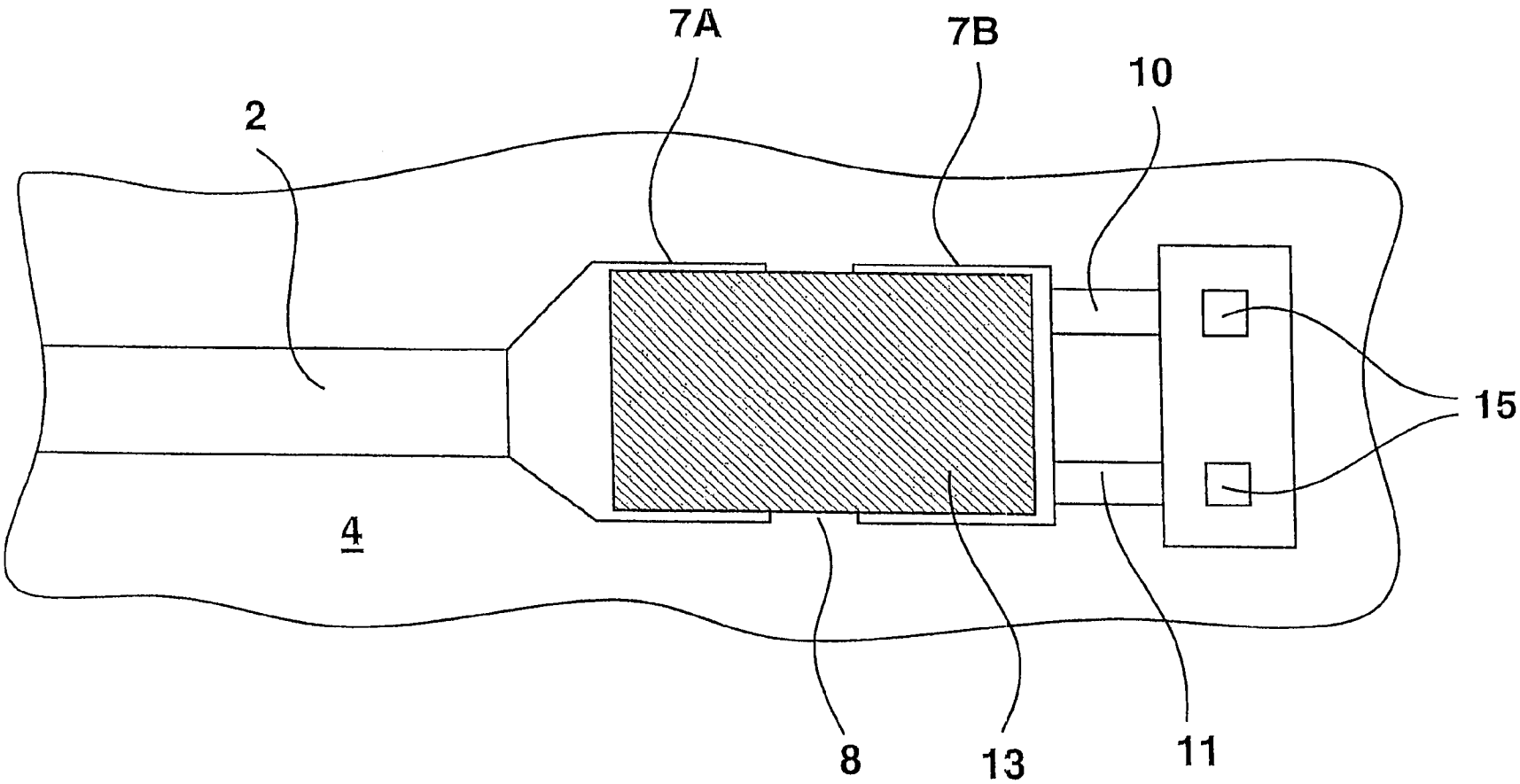
FIG. 2 schematically illustrates the upper surface of the structure shown in FIG. 1 including the placement of a DC blocking capacitor.

The provision of gap 8 makes it possible for the composite structure to be utilised in conjunction with a DC block capacitor since the provision of gap 8 allows the placement of the DC block capacitor. The gap 8 can be omitted if a serial DC block is not required. FIG. 2 shows schematically the placement of a serial DC blocking capacitor 13 in the modified co-planar waveguide transmission line structure.

The characteristic impedance of this modified co-planar waveguide structure is a function of the ratio of the width of the top surface of top conductor 7 to the total aperture width, W, across the ground conductor, provided thin substrates are used. As may be seen from FIG. 3, this figure shows schematically the reverse or bottom side of the substrate. The ground plane 16 covers the whole substrate surface except for the aperture 14 having the width W as indicated. The ground plane 16 is nominally divided into two regions; region 6 is the ground plane for the microstrip transmission line and region 12 which is the ground plane for the modified co-planar waveguide transmission line. The ground plane 16 can be connected to a packaging base, typically being part of a containment enclosure, incorporating a shallow recess beneath the ground plane aperture 14. The recess prevents the packaging base from acting as a continuation of the microstrip ground plane across the aperture region.

As may be noted the provision of the aperture 14 makes it possible for the width of the modified co-planar waveguide top surface to be increased to allow the use of a serial DC blocking capacitor or capacitor assembly. The required characteristic impedance is maintained by increasing the width of the aperture 14 in the ground plane conductor 16.

Using a parallel combination of the two sheet resistors 10 and 11, as shown in FIG. 1, provides broadband termination. The width of the modified co-planar waveguide centre conductor 7 is such that the sheet resisters can be positioned close to the outer edge of the conductor 7. This allows the sheet resisters 10 and 11 to be spaced such that a via 15 can be placed close to each sheet resister to connect the resisters and thus the electrode 7B with the lower ground plane 16. The spacing between, the vias is set such that the via to via spacing design rules for thin film processing are not contravened.

Figure 4:
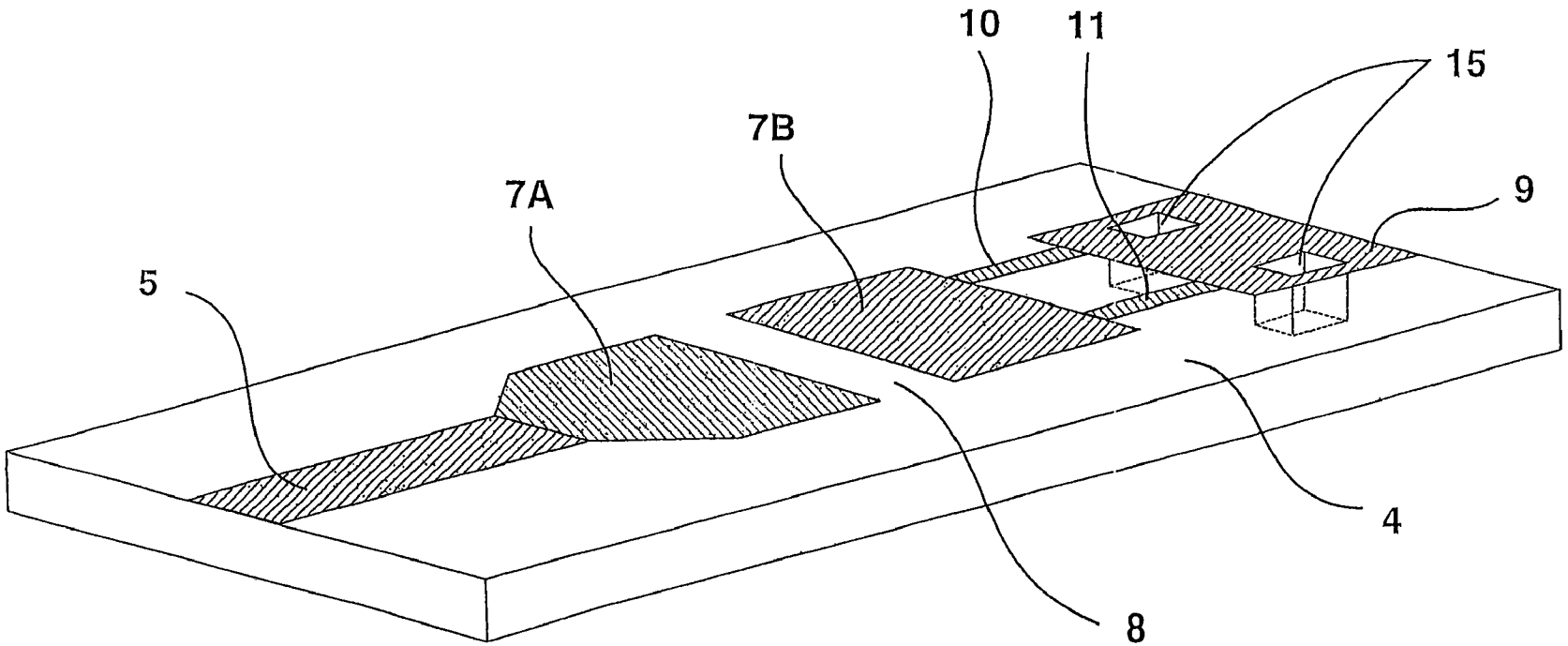
FIG. 4 schematically illustrates in perspective view a composite waveguide incorporating the concepts of the invention.

FIG. 4 shows schematically a perspective representation of the invention showing the top surface 4 of the substrate with the top conductors 5, 7A, 7B and 9, the sheet resisters 10 and 11 and the vias 15. For clarity the DC block capacitor is omitted in this figure.

It has been found that this configuration of sheet resisters and vias connected in parallel reduces the serial inductance of the design compared to the single sheet resistor and via configuration commonly used in microstrip circuits. This results in an improvement in the high frequency performance of the composite waveguide structure. Furthermore, the modified co-planar waveguide structure enables the inductance of the resistors to be compensated for by adjusting the ground plane aperture width to provide increased capacitive coupling.

Typically, the provisioning of additional vias using a conventional microstrip termination will not significantly improve the high frequency performance since the additional vias must be located away from the resistor. In the structure in accordance with the invention the low serial inductance of the configuration of sheet resistors and vias provides excellent high frequency performance.

A preferred embodiment of the invention providing broadband DC blocked termination of an RF signal has a 254 μm thick alumina substrate with a relative dielectric constant $\in_r \approx 9.95$ for operation at 40 GHz.

Figure 5:
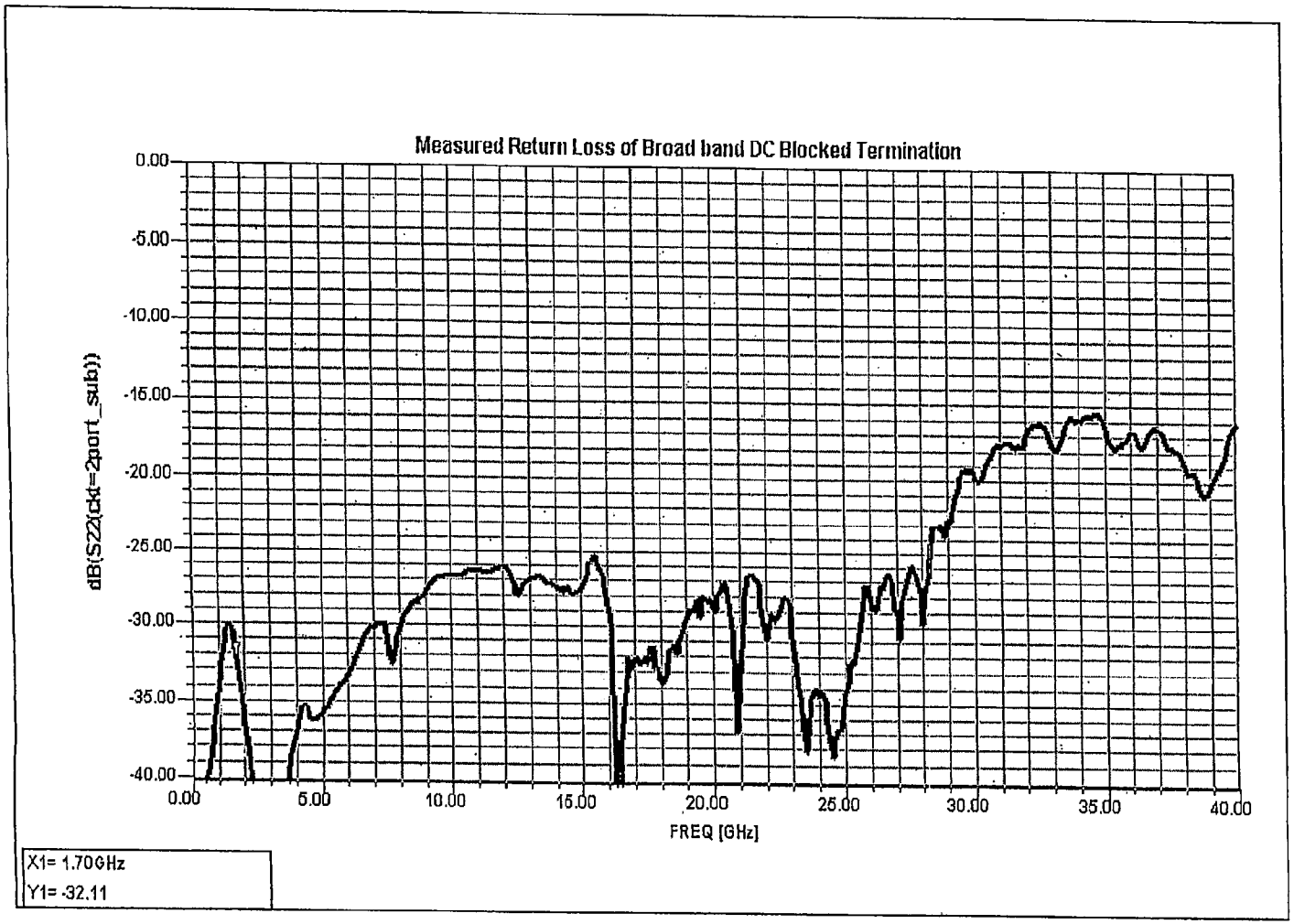
FIG. 5 is a graphical plot illustrating the relationship between the return loss, of a structure incorporating concepts of the invention, and frequency.

The width W of a modified co-planar waveguide central conductor was arranged to be suitable for the mounting of a broadband DC block capacitor assembly such as the OPTI-CAP™ from Dielectric Laboratories Inc. The design incorporating the broadband DC block capacitor assembly occupies a substrate area of 2.12 mm×1.5 mm. When such a design was tested using RF probed measurement techniques a return loss of better than 25 dB for frequencies below 27 GHz and 15 dB for frequencies up to 40 GHz was obtained. Measurements also showed that the design also worked well for frequencies down to 30 KHz. FIG. 5 shows the return loss of the structure as plotted against frequency.

The invention claimed is:

1. A composite waveguide termination structure, comprising at least two waveguide conductors having different geometries operatively located upon a common substrate, wherein each said waveguide conductor geometry includes a ground conductor on the same surface of the substrate, the ground conductors being electrically connected to each other, wherein a first of said geometries forms a microstrip transmission line and the second of said geometries forms a modified co-planar transmission line in which the ground conductor thereof is located on an opposite surface of the substrate to a conductor electrode thereof, and wherein the microstrip transmission line is arranged to feed into the co-planar transmission line.

2. The composite waveguide structure as claimed in claim 1, wherein the ground conductors of both geometrics are connected directly to a packaging base for the lines.

3. The composite waveguide termination structure as claimed in claim 1, wherein at least one of said geometries comprises a conductor electrode having two regions separated by a gap.

4. The composite waveguide termination structure as claimed in claim 3, wherein said gap is of such a size as to allow placement of a DC block capacitor at said gap.

5. A composite waveguide termination structure, comprising a first microstrip transmission line section including a substrate interposed between a first conductor electrode and a first ground conductor, a second modified co-planar transmission line section including a substrate that is an extension of the substrate of the first section, a second conductor electrode, and a second ground conductor, wherein the second ground conductor is provided on an opposite surface of the substrate relative to the second conductor electrode, and the second ground conductor is provided on the same surface of the substrate as the first ground conductor and is electrically connected therewith, and wherein the microstrip transmission line is arranged to feed into the co-planar transmission line.

6. The composite waveguide termination structure as claimed in claim 5, wherein the first and second ground conductors are connected directly to a packaging base for the lines.

7. A composite waveguide termination structure, comprising a microstrip transmission line that is arranged to feed into a modified co-planar transmission line having the same substrate as that of the microstrip transmission line, such that a ground conductor of each said microstrip and co-planar transmission lines are connected directly to a packaging base for the transmission lines, wherein the modified co-planar transmission line geometry is such that the ground conductor thereof is located on an opposite surface of the substrate to a conductor electrode thereof, and the ground conductor of both lines are provided on the same surface of the substrate and electrically connected to each other.

8. The composite waveguide termination structure as claimed in claim 7, wherein the co-planar transmission line includes a conductor electrode separated into two regions by a physical gap of such size so as to allow placement of a DC block capacitor at said gap.

9. The composite waveguide termination structure as claimed in claim 7, wherein a characteristic impedance of the microstrip transmission line is maintained by the coplanar transmission line by an aperture provided in the ground conductors.

10. The composite waveguide termination structure as claimed in claim 7, wherein a broadband termination is achieved by providing upon a first surface of the substrate a parallel combination of two sheet resistors that are placed adjacent to an outer edge of a two part main conductor provided upon said first surface, and wherein the sheet resistors are so positioned relative to each other as to enable the provision of at least one via whereby each sheet resistor and thus the main conductor parts can be connected to a ground plane provided upon a second surface of the substrate.

* * * * *